US012599833B2

(12) United States Patent
Liang

(10) Patent No.: US 12,599,833 B2
(45) Date of Patent: Apr. 14, 2026

(54) CARD SHUFFLING-AND-DEALING INTEGRATED MACHINE

(71) Applicant: WEIXING CHUANGKE (SHENZHEN) TECHNOLOGY CO., LTD., Shenzhen City (CN)

(72) Inventor: Yaowen Liang, Shenzhen (CN)

(73) Assignee: WEIXING CHUANGKE (SHENZHEN) TECHNOLOGY CO., LTD., Shenzhen City (CN)

( * ) Notice: Subject to any disclaimer, the term of this patent is extended or adjusted under 35 U.S.C. 154(b) by 338 days.

(21) Appl. No.: 18/430,574

(22) Filed: Feb. 1, 2024

(65) Prior Publication Data

US 2025/0018275 A1 Jan. 16, 2025

(30) Foreign Application Priority Data

Jul. 11, 2023 (CN) ..... 202310852281.2
Sep. 11, 2023 (CN) ..... 202322475615.7

(51) Int. Cl.
*A63F 1/12* (2006.01)
*A63F 1/00* (2006.01)
*A63F 1/14* (2006.01)

(52) U.S. Cl.
CPC ..... *A63F 1/12* (2013.01); *A63F 1/14* (2013.01); *A63F 2001/005* (2013.01)

(58) Field of Classification Search
CPC ..... A63F 1/12; A63F 2001/005
USPC ..... 273/149 R
See application file for complete search history.

(56) References Cited

U.S. PATENT DOCUMENTS

| | | | | |
|---|---|---|---|---|
| RE46,826 | E * | 5/2018 | Hill | G07F 17/3202 |
| 12,491,428 | B1 * | 12/2025 | Curley | A63F 1/12 |
| 12,502,598 | B1 * | 12/2025 | Curley | A63F 1/12 |
| 2017/0106270 | A1 * | 4/2017 | Shigeta | A63F 1/06 |
| 2017/0157499 | A1 * | 6/2017 | Krenn | A63F 1/14 |
| 2024/0115930 | A1 * | 4/2024 | Lucchetti | A63F 1/14 |
| 2025/0058206 | A1 * | 2/2025 | Curley | A63F 1/14 |
| 2025/0249345 | A1 * | 8/2025 | Liang | A63F 1/12 |
| 2026/0034431 | A1 * | 2/2026 | Curley | A63F 1/12 |

* cited by examiner

*Primary Examiner* — Allyson N Trail
(74) *Attorney, Agent, or Firm* — Li & Cai Intellectual Property Office

(57) ABSTRACT

A card shuffling-and-dealing integrated machine includes a housing having a card compartment, a card access port, a card-delivering port and a card dealing port; at least two card-holding plates provided on the housing, located on an upper peripheral side of the card compartment and having a card-shuffling channel; a card-shuffling mechanism provided at an entrance of the card-holding plate adjacent to the card-shuffling channel, and configured to stagger playing cards on the card-holding plates into the card compartment through the card-shuffling channel; a card-delivering mechanism provided at a bottom of the card compartment, and configured to deliver playing cards in the card compartment to the card-delivering port; and a card-dealing mechanism provided at a bottom of the card compartment and located between the card-delivering mechanism and the card-delivering port, and configured to deal playing cards located at the card-delivering port from the card-dealing port.

14 Claims, 14 Drawing Sheets

A-A

A

CARD SHUFFLING-AND-DEALING INTEGRATED MACHINE

FIELD OF THE DISCLOSURE

The present disclosure relates to the technical field of poker machines, and more particularly to a card shuffling-and-dealing integrated machine.

BACKGROUND OF THE DISCLOSURE

With the improvement of living standards, people's daily life has gradually become richer, and poker has become one of their favorite entertainment pastimes. However, after playing a round of cards, players need to sort, shuffle and deal the cards themselves. In order to save time or reduce the occurrence of cheating, automatic card-dealing machines have been developed to deal cards and automatic card-shuffling machines have been used to shuffle cards. However, it is rare to have a poker machine with both card-shuffling and card-dealing functions.

The Chinese invention patent application with publication number CN114534238A discloses a card-dealing machine with the functions of card-shuffling and card-dealing. The specification describes: "The card-dealing machine has higher working stability and reliability, small overall volume and simple structure while meeting the functions of shuffling and dealing." In fact, however, the card-dealing machine recited in the abovementioned Chinese invention patent application has separate shuffling parts and card-dealing parts, and the volume is still not small enough.

SUMMARY OF THE DISCLOSURE

The purpose of the present disclosure is to provide a card shuffling-and-dealing integrated machine, which has the advantages of integrating card-shuffling and card-dealing functions into one machine and having a small size in view of the defects and shortcomings of the existing technology.

In order to achieve the above objects, the technical solution adopted by the present disclosure is as follows. A card shuffling-and-dealing integrated machine is provided, which includes a housing having a card compartment for accommodating playing cards, a card access port located on a rear side of the card compartment, a card-delivering port located on a front bottom of the card compartment, and a card dealing port located on a front side of the housing and corresponding to the card-delivering port; at least two card-holding plates provided on the housing and located on an upper peripheral side of the card compartment, a card-shuffling channel being provided between the card compartment and the card-holding plate; a card-shuffling mechanism correspondingly provided at an entrance of the at least two card-holding plates adjacent to the card-shuffling channel, and configured to stagger the playing cards on the at least two card-holding plates into the card compartment respectively through the card-shuffling channels; a card-delivering mechanism provided at a bottom of the card compartment, and configured to deliver the playing cards in the card compartment to the card-delivering port; and a card-dealing mechanism provided at the bottom of the card compartment and located between the card-delivering mechanism and the card-delivering port, and configured to deal the playing cards located at the card-delivering port from the card-dealing port.

By virtue of the above technical solution, the beneficial effects of the present disclosure are as follows.

In the present disclosure, the card-holding plate is provided on the housing and located on the upper peripheral side of the card compartment, the card-shuffling mechanism is provided on the card-holding plate, and the card-delivering mechanism as well as the card-dealing mechanism are provided in the card compartment of the housing, so that when used, the playing cards are staggered into the card compartment through the card-shuffling channel under driving of the card-shuffling mechanism, and are dealt out directly under the action of the card-delivering mechanism and the card-dealing mechanism. Since the card-shuffling mechanism and the card-dealing mechanism share the card compartment, a volume of the card shuffling-and-dealing integrated machine is greatly reduced and miniaturization can be achieved.

BRIEF DESCRIPTION OF THE DRAWINGS

In order to explain the embodiments of the present disclosure or the technical solutions in the prior art more clearly, the drawings needed to be used in the description of the embodiments or the prior art will be briefly introduced below. Obviously, the drawings in the following description are only some embodiments of the present disclosure. For those of ordinary skill in the art, other drawings can be obtained based on these drawings without exerting any creative effort.

DETAILED DESCRIPTION OF THE EXEMPLARY EMBODIMENTS

Figure 1:
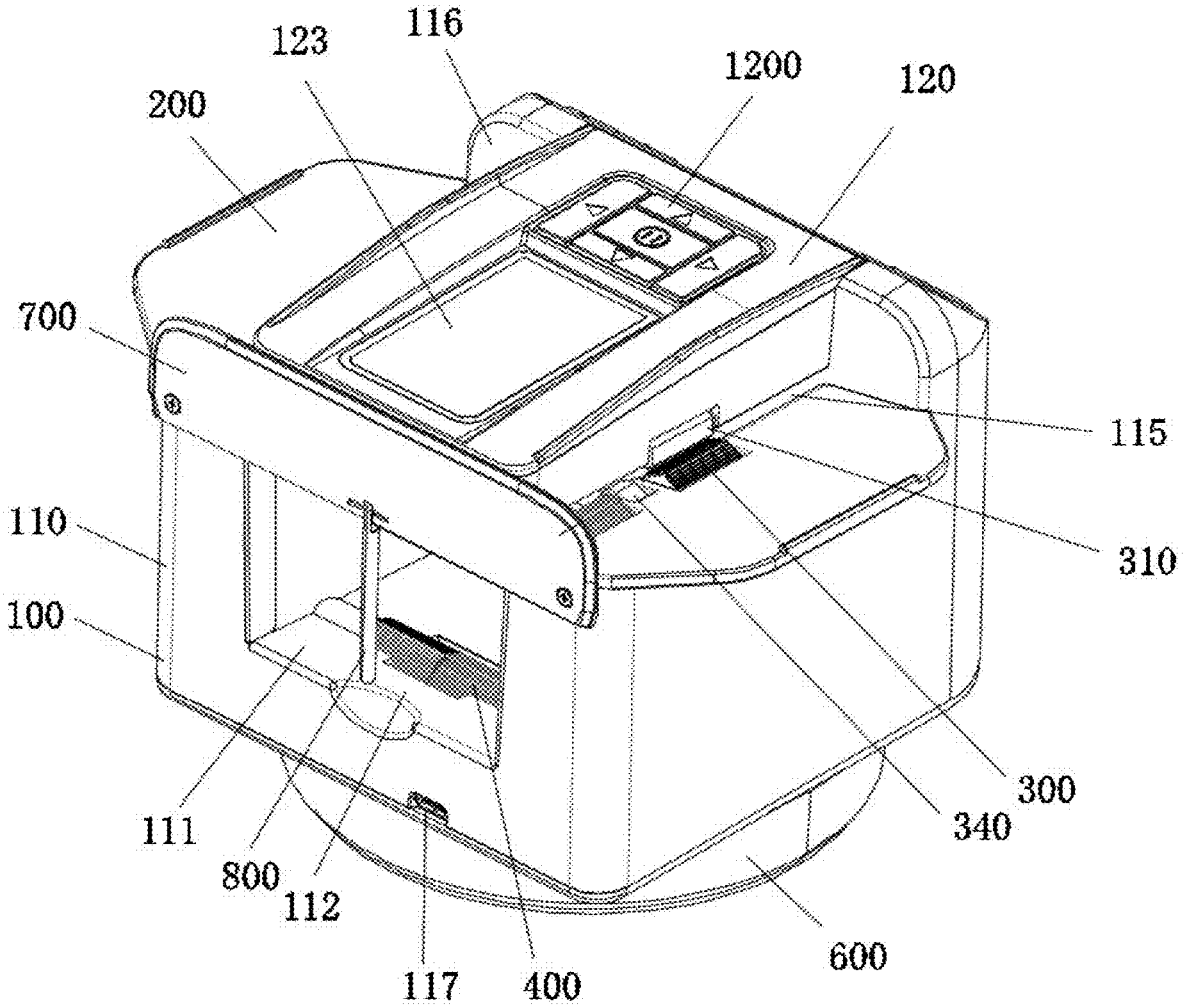
FIG. 1 is a schematic structural diagram according to the present disclosure.

The present disclosure will be further described in detail below with reference to the accompanying drawings.

This specific embodiment is only an explanation of the present disclosure, and is not a limitation of the present disclosure. Those skilled in the art can make modifications to this embodiment without creative contribution as needed after reading this description, and as long as they are within the scope of the claims of the present disclosure, they are protected by the patent law.

The present embodiment relates to a card shuffling-and-dealing integrated machine, as shown in FIGS. 1 to 2 and FIGS. 12 to 13, which includes a housing 100, at least two card-holding plates 200, a card-shuffling mechanism 300, a card-delivering mechanism 400, a card-dealing mechanism 500 and a rotating base 600. The housing 100 has a card compartment 111 for accommodating playing cards, a card access port 112 located at a rear side of the card compartment 111, a card-delivering port 113 located at a front bottom of the card compartment 111, and a card dealing port 114 located on a front side of the housing 100 and corresponding to the card-delivering port 113. The card-holding plate 200 is arranged on the housing 100 and is located on an upper peripheral side of the card compartment 111, and a card-shuffling channel 115 is provided between the card-holding plate 200 and the card compartment 111. The card-shuffling mechanism 300 is disposed at an entrance of the card-holding plate 200 adjacent to the card-shuffling channel 115, and is configured to alternately drop the playing cards on the at least two card-holding plates 200 into the card compartment 111 respectively through the card-shuffling channels 115. The card-delivering mechanism 400 is provided at a bottom of the card compartment 111 and is configured to deliver the playing cards in the card compartment 111 to the card-delivering port 113. The card-dealing mechanism 500 is disposed at the bottom of the card compartment 111 and located between the card-delivering mechanism 400 and the card-delivering port 113, and is configured to deal the playing cards located at the card-delivering port 113 from the card dealing port 114. The rotating base 600 is provided on a lower side of the housing 100. A rotating structure is provided between the rotating base 600 and the housing 100. The housing 100 can rotate relative to the rotating base 600 to deal cards in multiple directions.

The card-holding plate 200 is provided on the housing 100 and is located at the upper peripheral side of the card compartment 111, and the card-shuffling mechanism 300 is provided on the card-holding plate 200. The card-delivering mechanism 400 and the card-dealing mechanism 500 are provided in the card compartment 111 of the housing 100, so that when used, the playing cards are staggered and dropped into the card compartment 111 through the card-shuffling channel 115 by the driving of the card-shuffling mechanism 300, and are directly dealt out by the action of the card-delivering mechanism 400 and the card-dealing mechanism 500. Since the shuffling and dealing of playing cards share the card compartment 111, a volume of the card shuffling-and-dealing integrated machine is greatly reduced, and miniaturization can be achieved.

Specifically, in the present embodiment, as shown in FIGS. 1 to 5, the housing 100 includes a main housing 110 having the card compartment 111 and a square prism shape as a whole, and an upper baffle 120 located correspondingly on upper sides of the main housing 110 and the card compartment 111. A top side of the main housing 110 and a surface where the card access port 112 is located are completely open. A side of the main housing 110 away from the card access port 112 is provided with an extension portion 116 that is upwardly protruding. The upper baffle 120 is connected to the extension portion 116. In the present embodiment, two card-holding plates 200 are provided, and the two card-holding plates 200 are symmetrically and respectively arranged on two sides of the main housing 110 adjacent to the extension portion 116. The card-shuffling channel 115 is located between the main housing 110, each of the two card-holding plates 200 and the upper baffle 120. In other embodiments, the housing 100 may also be other shapes, such as a cylinder, a hexagonal prism, etc. Correspondingly, a number of the card-holding plates 200 can also be more than two.

Figure 9:
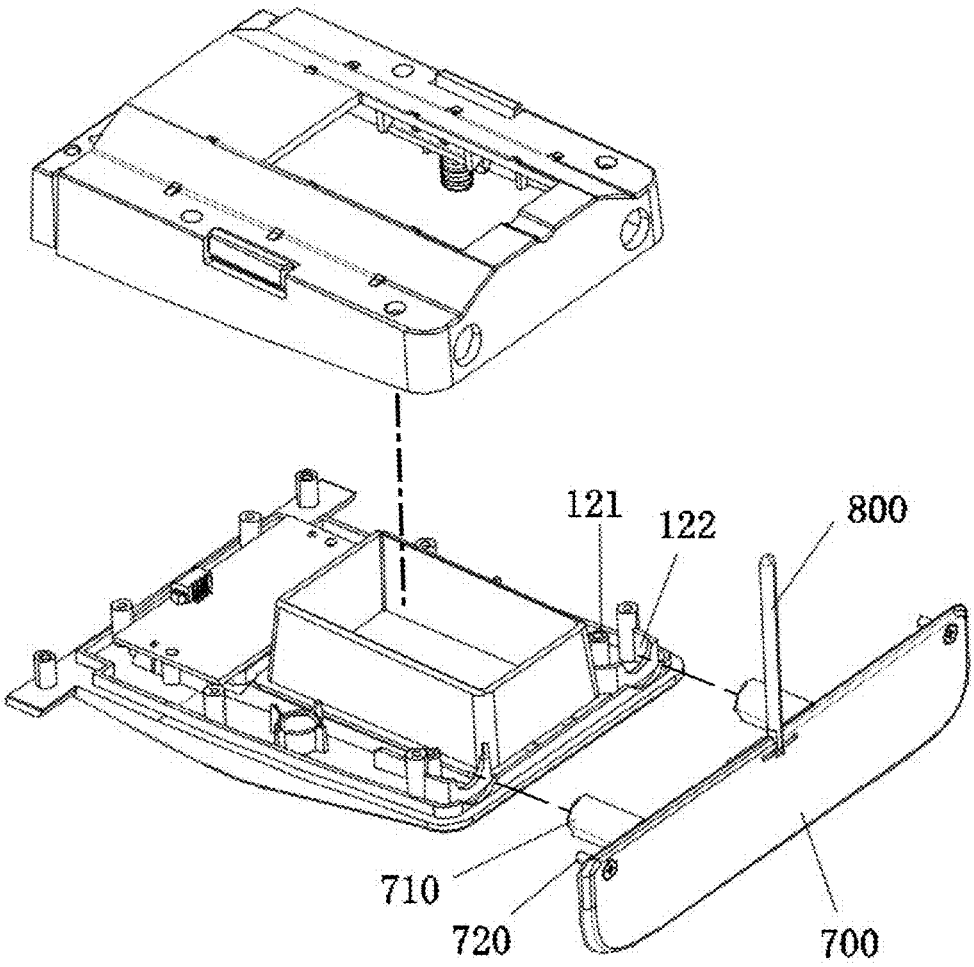
FIG. 9 is a schematic exploded diagram of the upper baffle and the card baffle from another perspective according to the present disclosure.

In the present embodiment, as shown in FIG. 9, a bottom surface of the upper baffle 120 is arranged in an inverted eight shape. Therefore, when the playing cards are shuffled, the playing cards located on the card-holding plates 200 respectively on the two sides of the main housing 110 are driven by the shuffling mechanism 300 to pass through the card-shuffling channel 115 and follow the bottom structure of the upper baffle 120 so as to staggeredly drop into the card compartment 111. The structure of the inverted eight shape plays a guiding role for the playing cards.

In a preferred embodiment, as shown in FIGS. 1 to 2 and FIGS. 7 to 9, the upper baffle 120 is provided with a card baffle 700 on an upper side of the card access port 112, and the card baffle 700 extends to block sides of the card-holding plates 200 respectively on the two sides of the main housing 100 facing the card access port 112 to limit a position of the playing cards located on the card-holding plates 200. The card baffle 700 has at least two functions. One function is to prevent the playing cards from falling, and the other function is to align the playing cards located on the card-holding plates 200. Without providing the card baffle 700, the playing cards may easily fall from the card-holding plates 200 under the action of the card-shuffling mechanism 300. Even if the playing cards may not fall, the playing cards are scattered by the action of the card-shuffling mechanism 300, thus easily getting stuck in the card-shuffling channel 115.

On this basis, in order to be able to adapt to playing cards of different sizes, the card baffle 700 and the upper baffle 120 are connected to each other in a pull-out manner. When the card baffle 700 is pulled outward, the card baffle 700 moves away from the extension portion 116, so that a distance between the card baffle 700 and the extension portion 116 is increased, and longer playing cards can be placed on the card-holding plates 200. Since the card baffle 700 is movable, the card baffle 700 is pulled out, then the playing cards are placed thereon, and finally the card baffle 700 is pushed back, so that one end of the playing cards resists the extension portion 116 of the main housing 110, and another end of the playing cards resists the card baffle 700. Therefore, the playing cards can neither fall nor be scattered during shuffling, making the shuffling smoother.

In a preferred embodiment, a limiting structure is provided between the card baffle 700 and the upper baffle 120 to limit a maximum slide-out position of the card baffle 700.

In a preferred embodiment, a positioning structure is provided between the card baffle 700 and the upper baffle 120, so that the card baffle 700 can be positioned at a predetermined position or any position.

Figure 7:
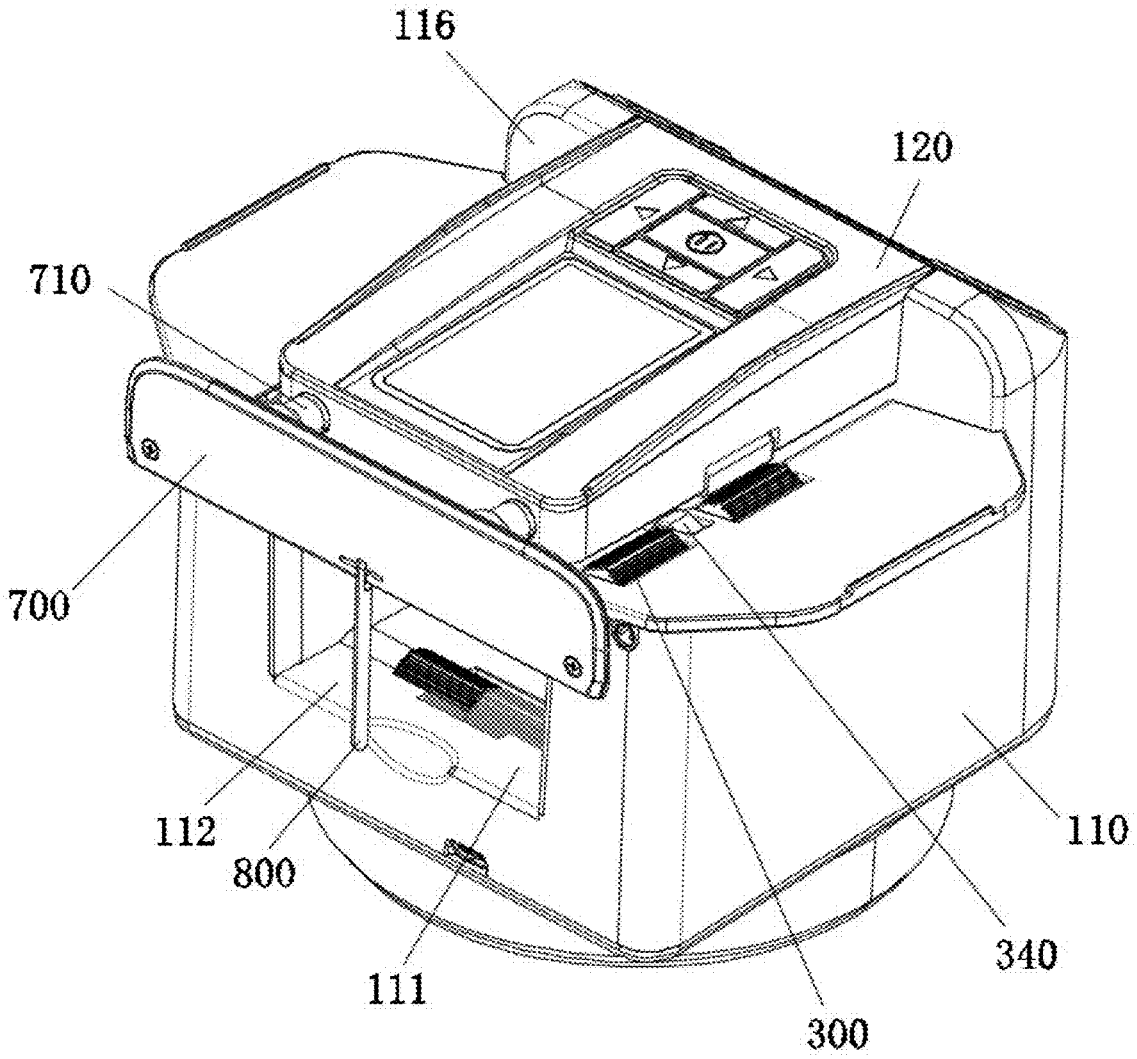
FIG. 7 is a schematic structural diagram of a card baffle being pulled outward according to the present disclosure.
Figure 8:
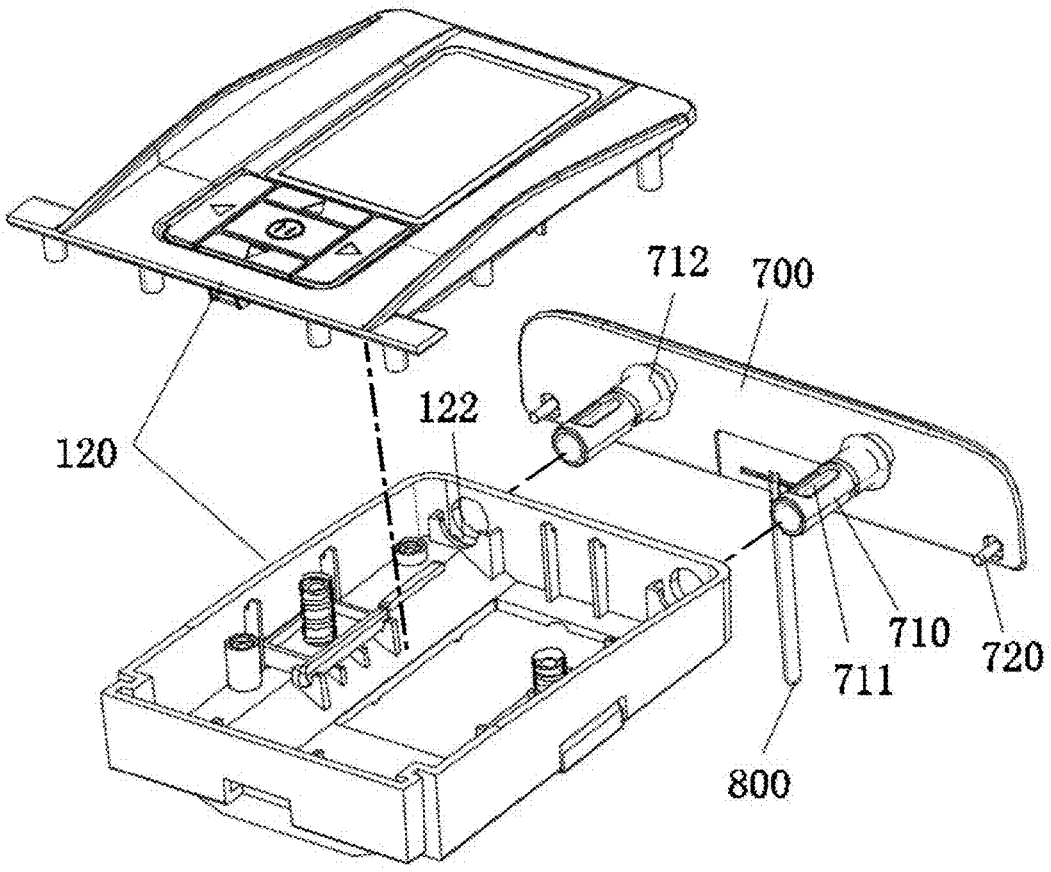
FIG. 8 is a schematic exploded diagram of the upper baffle and the card baffle according to the present disclosure.

Specifically, in the present embodiment, as shown in FIGS. 7 to 9, an inner side of the card baffle 700 is provided with a sliding rod 710 that is inserted into the upper baffle 120 and slidable relative to the upper baffle 120. In other embodiments, a slide rail and a sliding structure can also be used to realize the pull-out of the card baffle 700. Other specific methods can also be used, but the present disclosure is not limited thereto.

In a specific embodiment, as shown in FIGS. 8 and 9, the sliding rod 710 is provided with a length adjustment hole 711, and the upper baffle 120 is provided with a limiting post 121 inserted into the length adjustment hole 711 and being slidable relative to the length adjustment hole 711. When the card baffle 700 is pulled to a farthest position, the length adjustment hole 711 may be stuck by the limiting post 121 in the upper baffle 120, so that the card baffle 700 cannot be pulled outward anymore. In other embodiments, other specific structures may also be used to implement the limiting function.

In a specific embodiment, as shown in FIGS. 8 and 9, the upper baffle 120 is provided with an installation groove 122, and the sliding rod 710 is slidably sleeved with a damping ring 712 that is configured to be located in the installation groove 122. When the card baffle 700 is pulled, the damping ring 712 may not move but is fixed in the installation groove 122 to increase friction to achieve a positioning effect. In other embodiments, other specific structures may also be used to implement the positioning function.

Since only one end of the upper baffle 120 is fixedly connected to the extension portion 116 of the main housing 110 and another three ends are free ends, after long-term use, the end of the upper baffle 120 away from the extension portion 116 is prone to sagging, thereby blocking the card-shuffling channel 115 and affecting the card dealing function. Therefore, as shown in FIGS. 8 and 9, the inner side of the card baffle 700 is provided with an inserting post 720 that is slidably inserted into the main housing 110 and located at a lower side of the card-holding plate 200. In this way, an additional support point is formed for the upper baffle 120 to prevent the upper baffle 120 from sagging. Since the inserting post 720 is slidably connected to the main housing 110, the inserting post 720 can move outward for a certain distance without affecting a movement of the card baffle 700.

Figure 2:
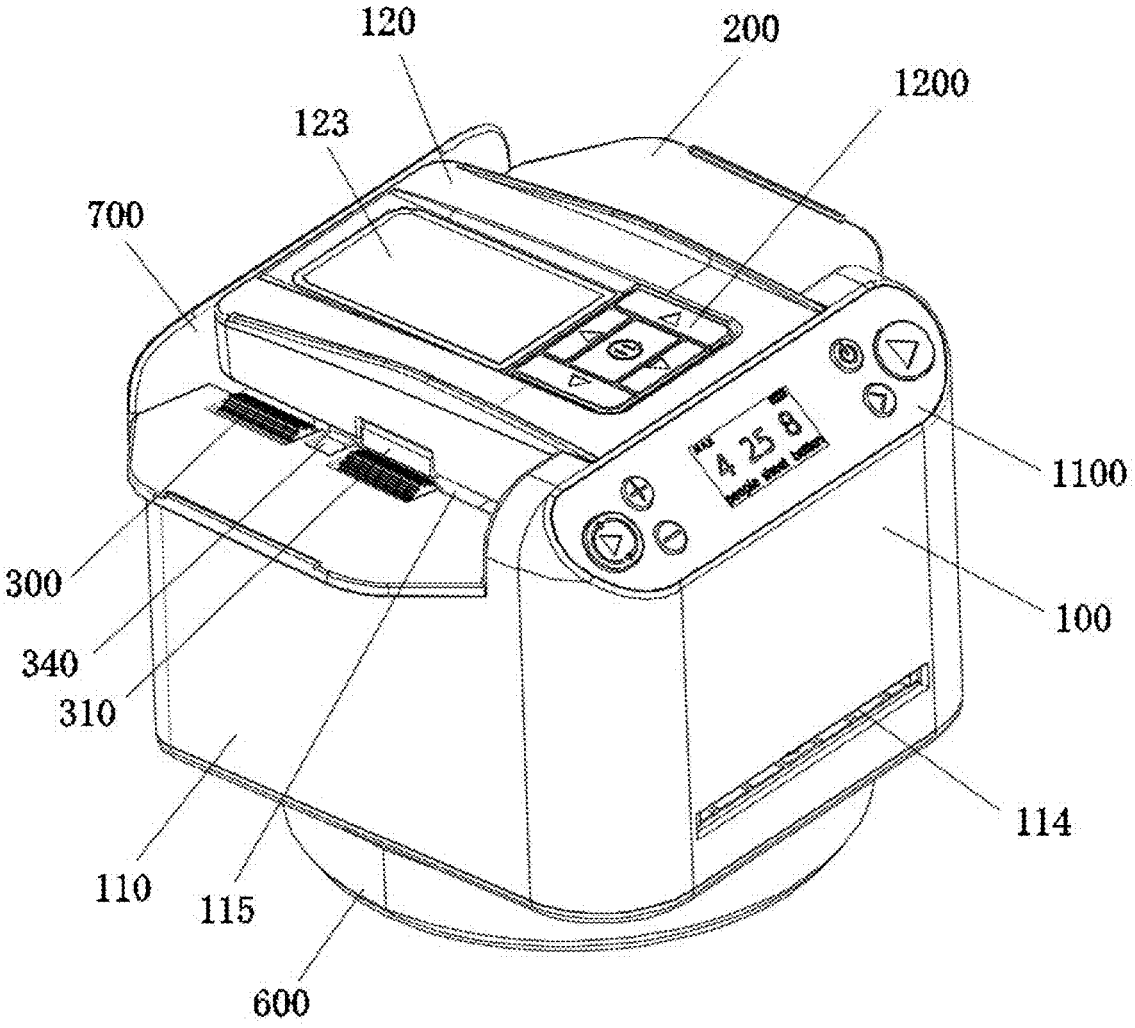
FIG. 2 is a schematic structural diagram from another perspective according to the present disclosure.

In a preferred embodiment, as shown in FIGS. 1 and 2, the upper baffle 120 is provided with a skylight, and an upper cover of the skylight is provided with a transparent baffle 123. Through the transparent baffle 123, an inside of the card compartment 111 can be observed. The transparent baffle 123 and the upper baffle 120 may be detachably connected, rotationally connected, or fixedly connected to each other.

In a preferred embodiment, as shown in FIGS. 1, 2 and 7, the card shuffling-and-dealing integrated machine also includes a card-blocking rod 800 of which an upper end is connected to a part of the housing 100 above the card access port 112 and a lower end is a free end for blocking the card access port 112. The card-blocking rod 800 is rotatably connected to the housing 100, and a rotating surface of the card-blocking rod 800 is parallel to the surface of a card dealing direction of the card shuffling-and-dealing integrated machine.

By providing the card-blocking rod 800, when the playing cards drop into the card compartment 111 after being shuffled, the playing cards may not fall out of the card access port 112, and the card-blocking rod 800 can also align the playing cards in place during the blocking process. Since the card-blocking rod 800 is rotatable, the playing cards can also be directly placed into the card compartment 111 from the card access port 112 for subsequent card dealing. When the playing cards are placed, the card-blocking rod 800 may be pushed out and rotated toward an upper side of an interior of the card compartment 111, which will not affect the playing cards being placed into the card compartment 111 from the card access port 112. After the playing cards are placed in such way, the card-blocking rod 800 may also press on the playing cards to act as a card-pressing rod, which is more conducive to subsequent card dealing. Another function of the rotatable card-blocking rod 800 is that the playing cards located in the card compartment 111 can be taken out from the card access port 112.

In the present embodiment, the card-blocking rod 800 is centrally located, so as to better block the playing cards. In some embodiments, two or several card-blocking rods 800 may also be provided, and a shape of the card-blocking rod 800 is not limited to a rod shape.

In one embodiment, a card-blocking rod fixing member for fixing the card-blocking rod 800 is provided on an upper side of an interior of the housing 100. For example, the card-blocking rod fixing member can be a C-shaped buckle, which can fix the card-blocking rod 800 on the upper side of the interior of the housing 100. When using such fixation function, the card shuffling function cannot be used, but it is more convenient to place the playing cards directly into the card compartment 111 from the card access port 112, and the card dealing function is not affected.

The card-blocking rod 800 can be used independently, or can be combined with the card baffle 700. That is, when the card baffle 700 is provided, an upper end of the card-blocking rod 800 is rotatably connected to the card baffle 700.

In the card shuffling-and-dealing integrated machine of the present disclosure, the card-holding plate 200 also has many innovative points.

Figure 3:
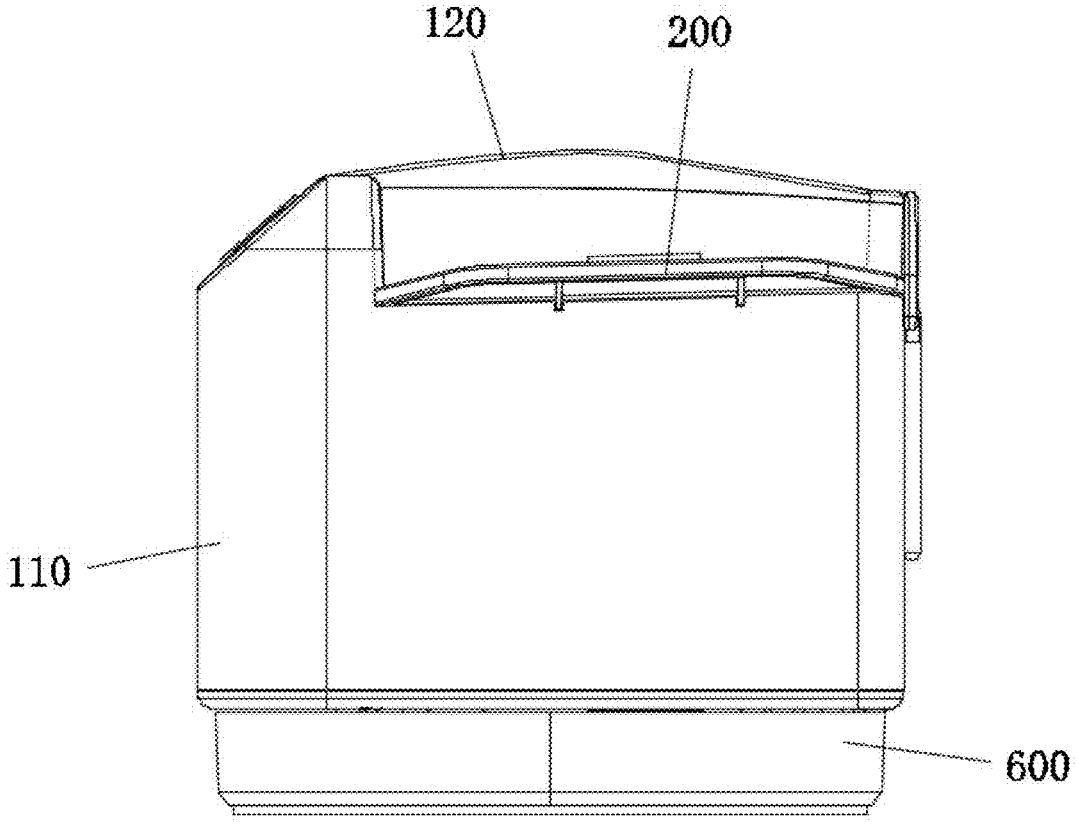
FIG. 3 is a schematic side view according to the present disclosure.

As shown in FIGS. 1 to 3, the card-holding plate 200 is arranged at an angle, and a side of the card-holding plate 200 connected to the extension portion 116 is lower than a side of the card-holding plate 200 adjacent to the card access port 112. Therefore, the playing cards placed on the card-holding plate 200 may slide towards the extension part 116 to achieve the alignment. When shuffling the playing cards, since one side of the playing cards is always in contact with the extension part 116, the playing cards may not be scattered, which improves smoothness of the shuffling. Such inclined setting cooperates with the card baffle 700 to achieve a better effect. When the card baffle 700 is adjustable, it can adapt to longer playing cards.

In other embodiments, the card baffle 700 may not be provided, and certain longer playing cards may also be placed.

In the present embodiment, the angle at which the card-holding plate 200 is tilted toward the extension portion 116 is 7 degrees to ensure that the playing cards placed on the card-holding plate 200 may slide toward the extension part 116 to achieve the alignment. Certainly, in other embodiments, the tilt angle can also be set to: 2 degrees, 3 degrees, 4 degrees, 5 degrees, 6 degrees, 8 degrees, 9 degrees, 10 degrees, 11 degrees, 12 degrees, 13 degrees, 14 degrees, 15 degrees, 20 degrees, 25 degrees, 30 degrees, 35 degrees, 40 degrees, 45 degrees, 50 degrees, 55 degrees, 60 degrees, etc.

In the present embodiment, the card-holding plate 200 is also inclined toward the card compartment 111, and a side of the card-holding plate 200 adjacent to the card-shuffling channel 115 is lower than a side of the card-holding plate 200 away from the card-shuffling channel 115. The playing cards placed on the card-holding plates 200 respectively on the two sides of the main housing 110 may tend to the card-shuffling channel 115, thereby improving the smoothness of the card shuffling. By cooperating with the inverted eight-shaped structure on the bottom surface of the upper baffle 120, the smoothness of shuffling can be further improved, and the playing cards located on the two card-holding plates 200 can be staggered and dropped into the card compartment 111 during the shuffling. Even if the playing cards entered correspondingly from the two sides collide, the playing cards will not get stuck.

Figure 4:
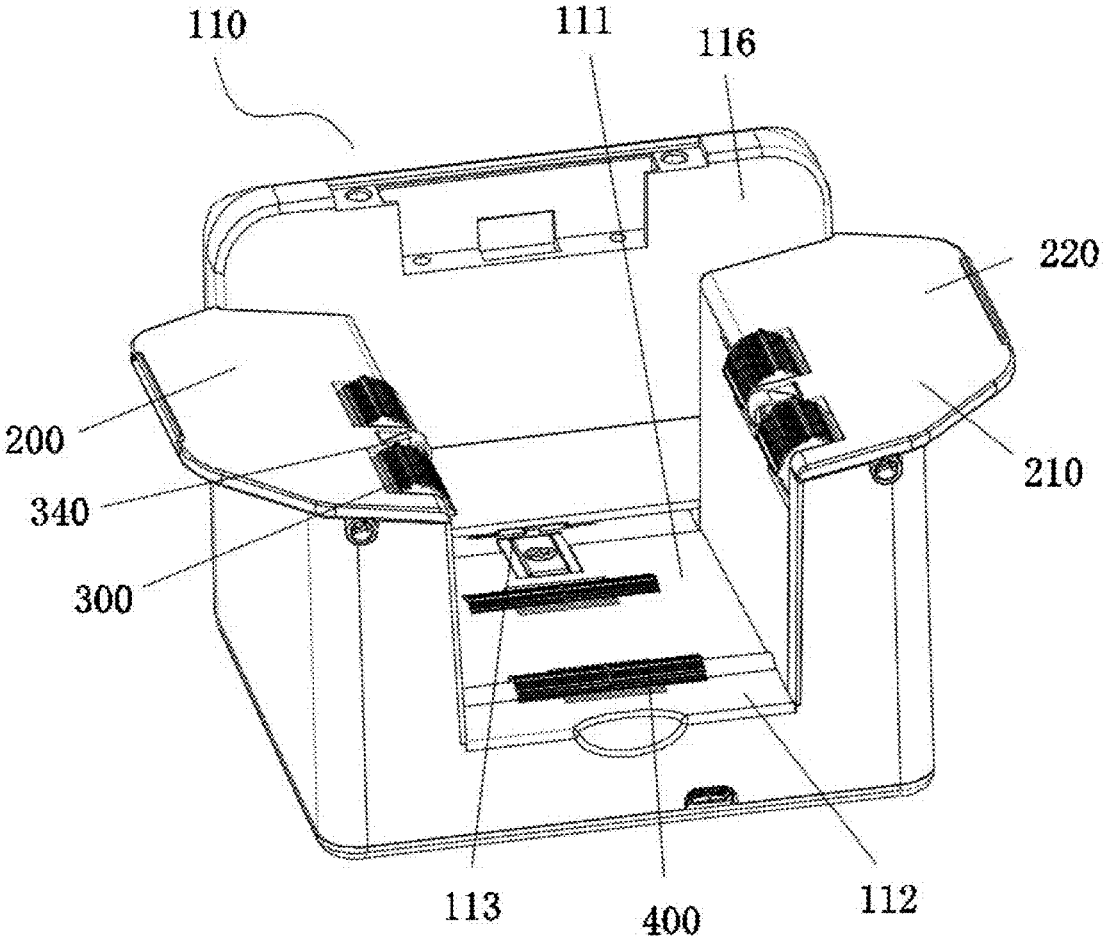
FIG. 4 is a schematic structural diagram of a main housing and card-holding plates according to the present disclosure.

In a preferred embodiment, as shown in FIG. 4, the card-holding plate 200 includes a first card-holding plate 210 located on the housing 100, and a second card-holding plate 220 connected to the first card-holding plate 210 and extending and suspending outwardly. The second card-holding plate 220 is trapezoidal-shaped, and a side of the second card-holding plate 220 away from the first card-holding plate 210 is a short side, making it easier to remove the playing cards placed on the card-holding plate 200 and making it look more attractive.

In order to prevent a user from being scratched by touching a corner of the second card-holding plate 220 when playing cards, especially a risk greater when the card shuffling-and-dealing integrated machine rotates to deal cards, corners of the second card-holding plate 220 may be rounded off.

In a preferred embodiment, as shown in FIGS. 1, 2, 5 and 6, an elastic floating member 310 with a downward rebound direction is provided on a lower side of the upper baffle 120 and at a middle position of the card-shuffling channel 115.

The elastic floating member 310 may press the playing cards passing through the card-shuffling channel 115 toward the card-holding plate 200, so that the playing cards fully contact the card-shuffling mechanism 300 on the card-holding plate 200, thereby improving the smoothness of the shuffling. In addition, by limiting a maximum floating height of the elastic floating member 310, a number of playing cards entering the card-shuffling channel 115 at a time is limited. Since the elastic floating member 310 is disposed in the middle of the card-shuffling channel 115, in a case that the playing cards have been bent due to use, the curved sides of the playing cards can still pass through the card-shuffling channel 115 smoothly, thereby avoiding card jams during the card-shuffling process.

Figure 5:
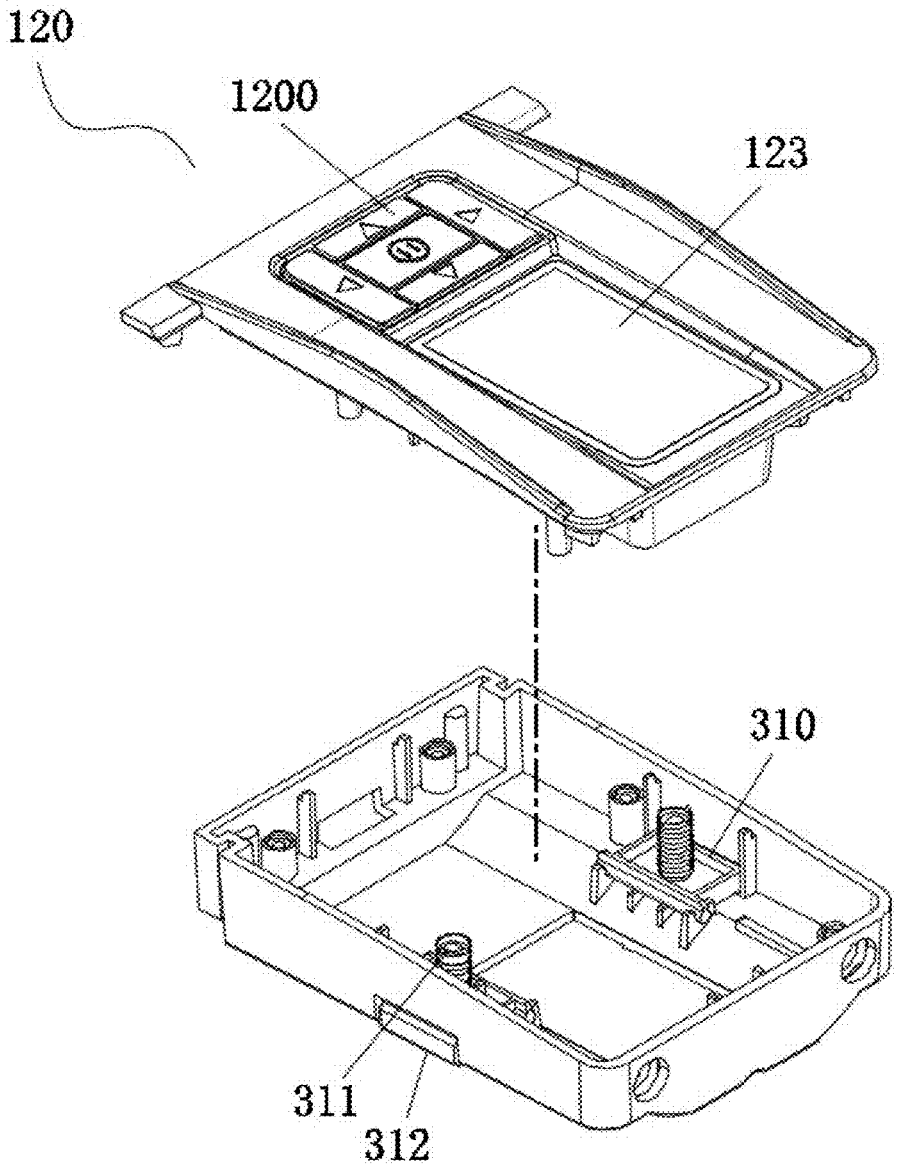
FIG. 5 is a schematic exploded diagram of an upper baffle according to the present disclosure.
Figure 6:
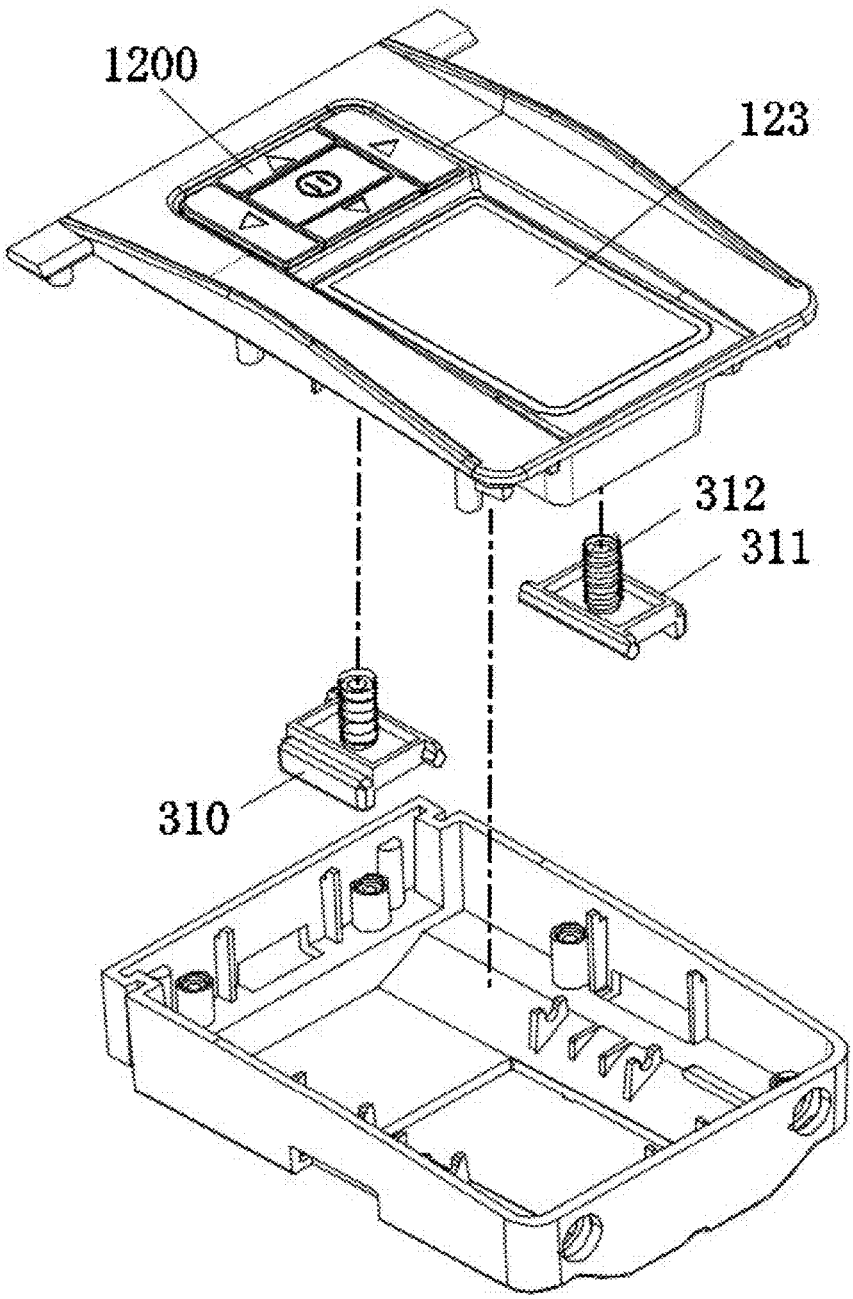
FIG. 6 is a schematic exploded diagram of the upper baffle and an elastic floating member according to the present disclosure.

Specifically, in the present embodiment, as shown in FIGS. 5 and 6, the elastic floating member 310 includes a card-pressing member 311 and an elastic member 312. The card-pressing member 311 is disposed in the upper baffle 120 and has an active end extending downwardly from the upper baffle 120. The elastic member 312 is disposed in the upper baffle 120, with one end resisting the upper side of the interior of the upper baffle 120. Another end resists the card-pressing member 311 so that a rebound direction of the card-pressing member 311 faces downward.

Figure 12:
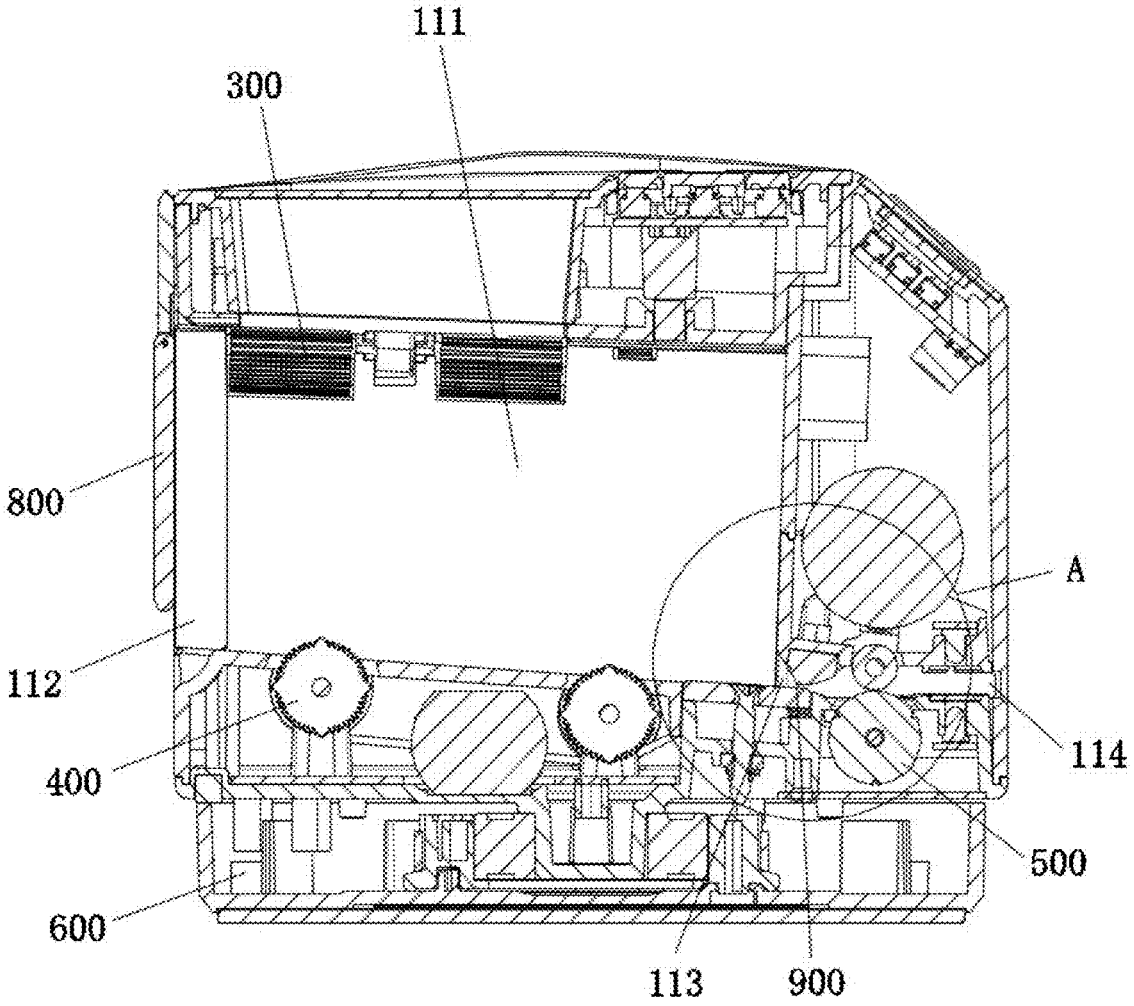
FIG. 12 is a cross-sectional view taken along the A-A direction in FIG. 11.
Figure 13:
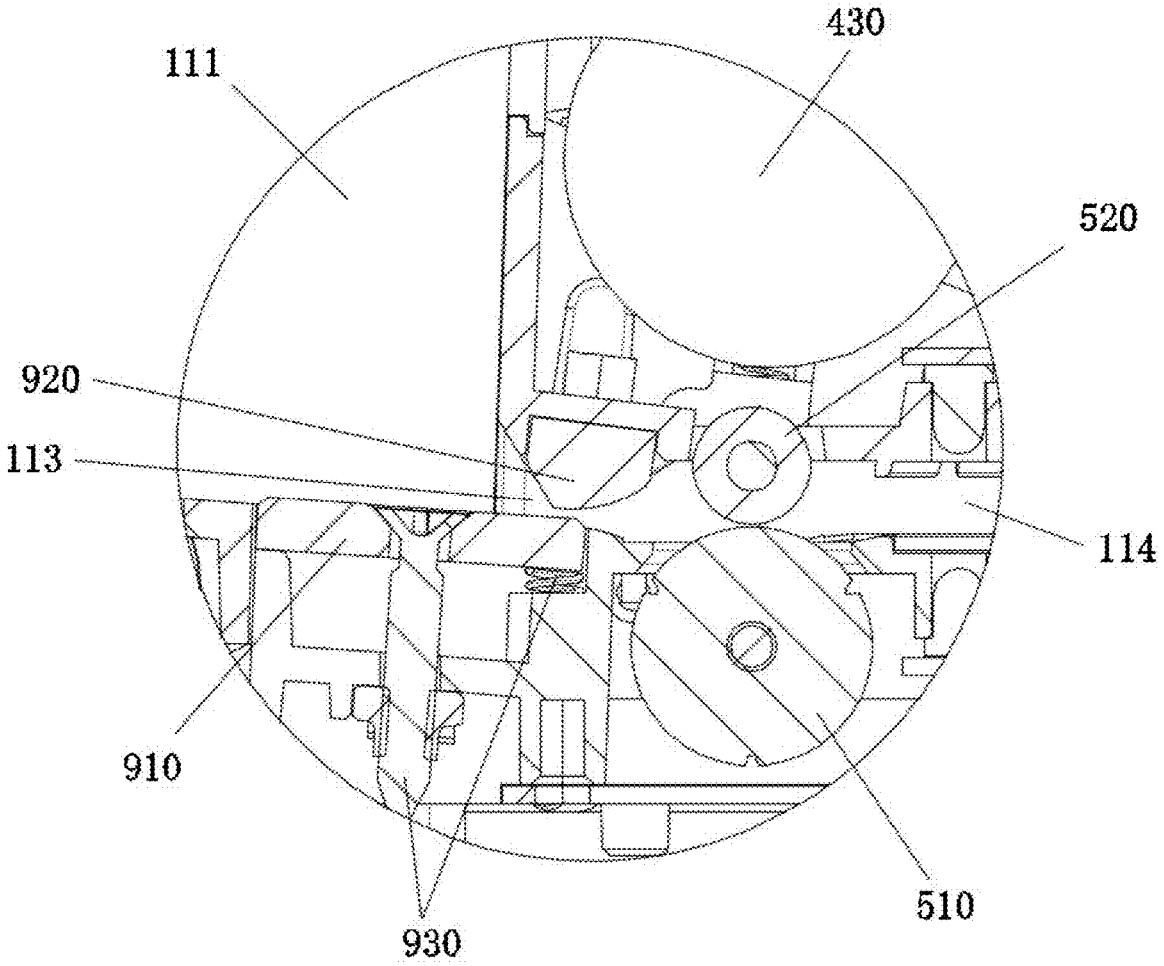
FIG. 13 is an enlarged view of part A in FIG. 12.
Figure 14:
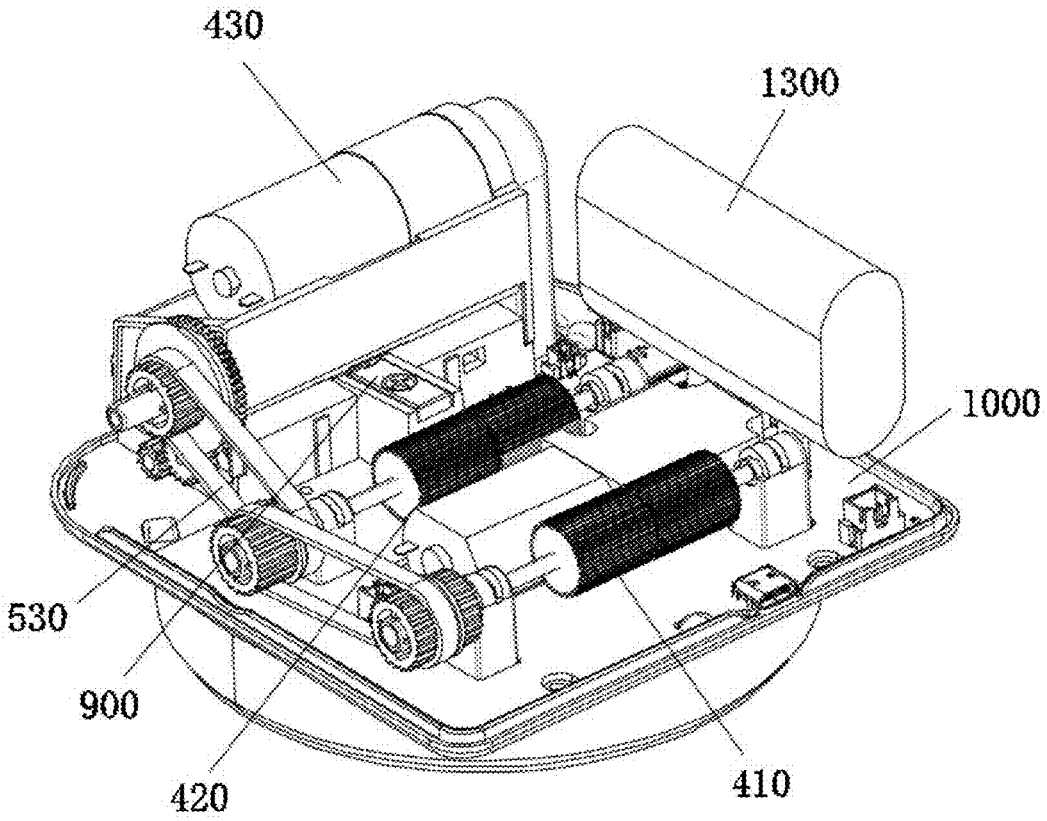
FIG. 14 is a schematic diagram of an internal structure of the main housing according to the present disclosure.

As shown in FIGS. 12 to 14, in the present embodiment, the card-delivering mechanism 400 includes a first card-delivering roller assembly 410, a second card-delivering roller assembly 420, and a card-delivering motor. The first card-delivering roller assembly 410 is located at a bottom of the interior of the card compartment 111 and adjacent to the card access port 112. The second card-delivering roller assembly 420 is located at the bottom of the interior of the card compartment 111 and adjacent to the card-delivering port 113. The card-delivering motor is configured to drive the first card-delivering roller assembly 410 and the second card-delivering roller assembly 420 to rotate.

When the card shuffling-and-dealing integrated machine deals cards, with a cooperation of the first card-delivering roller assembly 410 and the second card-delivering roller assembly 420, a friction between the card-delivering roller assembly and the playing cards is increased, so that the playing cards can be dealt out without providing additional card pressing equipment to increase friction.

As shown in FIGS. 12 to 14, in the present embodiment, the card-dealing mechanism 500 includes a card-dealing roller assembly 510, an elastic card-pressing assembly 520, and a card-dealing motor that provides power for the card-dealing roller assembly 510.

The card-dealing roller assembly 510 is located at the bottom of the interior of the card compartment 111 and between the card-delivering port 113 and the card-dealing port 114. The elastic card-pressing assembly 520 is located above the card-dealing roller assembly 510, and with a rebound direction downward. The card-dealing motor is used to drive the card-dealing roller assembly 510 to rotate. The elastic card-pressing assembly 520 can increase the friction between the playing cards and the card-dealing roller assembly 510 without increasing the resistance of the playing cards. The elastic card-pressing assembly 520 that floats up and down can offset uncertainty of a thickness and surface state of the playing cards to achieve smooth and uniform card play.

In the present embodiment, the card-delivering mechanism 400 and the card-dealing mechanism 500 share a motor, that is, the card-delivering motor and the card-dealing motor are collectively referred to as a card delivering-and-dealing motor 430, which drives the first card-delivering roller assembly 410, the second card-delivering roller assembly 420 and the card-dealing roller assembly 510 to rotate together through the transmission structure 530.

As shown in FIGS. 12 to 14, in the present embodiment, a limiting mechanism 900 is provided at the card-delivering port 113 for adjusting a height of the card-delivering port 113 to limit the number of playing cards entering the card-delivering port 113 at a time. The limiting mechanism 900 includes a lower card-distributing block 910, an upper card-distributing block 920 arranged below the lower card-distributing block 910 and corresponding to the lower card-distributing block 910, and an adjustment device 930 for adjusting a height of the lower card-distributing block 910.

When dealing cards, the card delivering-and-dealing motor 430 drives the first card-delivering roller assembly 410, the second card-delivering roller assembly 420 and the card-dealing roller assembly 510 to rotate by driving the transmission structure 530. The first card-delivering roller assembly 410 and the second card-delivering roller assembly 420 rubs against the playing cards located on the upper side thereof, causing friction to drive the playing cards to move toward the card-delivering port 113. Then the playing cards pass through a region between the card-dealing roller assembly 510 and the elastic card-pressing assembly 520 to achieve smooth and uniform card dealing by a cooperation of the card-dealing roller assembly 510 and the elastic card-pressing component 520.

Figure 10:
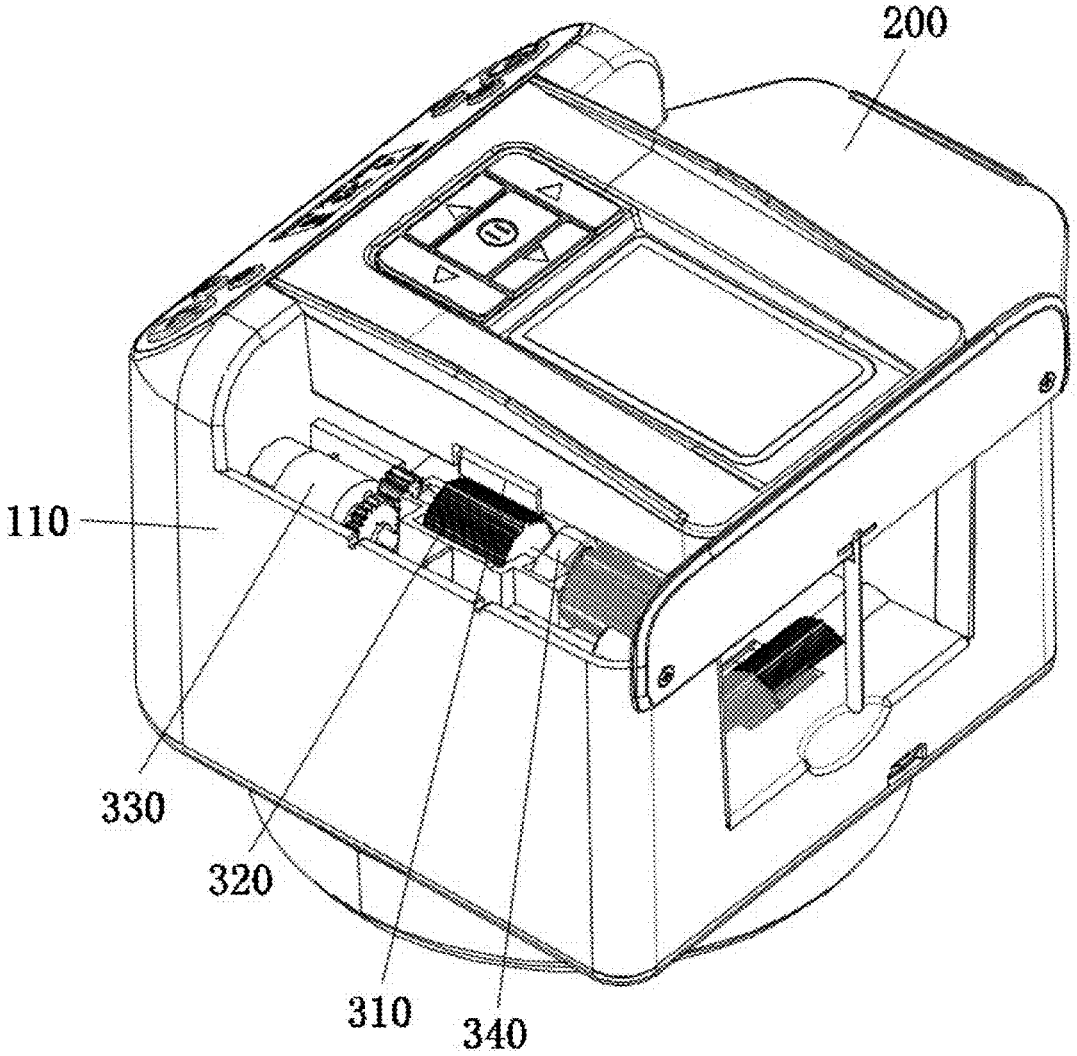
FIG. 10 is a schematic structural diagram showing a part of the card-holding plate being hidden according to the present disclosure.
Figure 11:
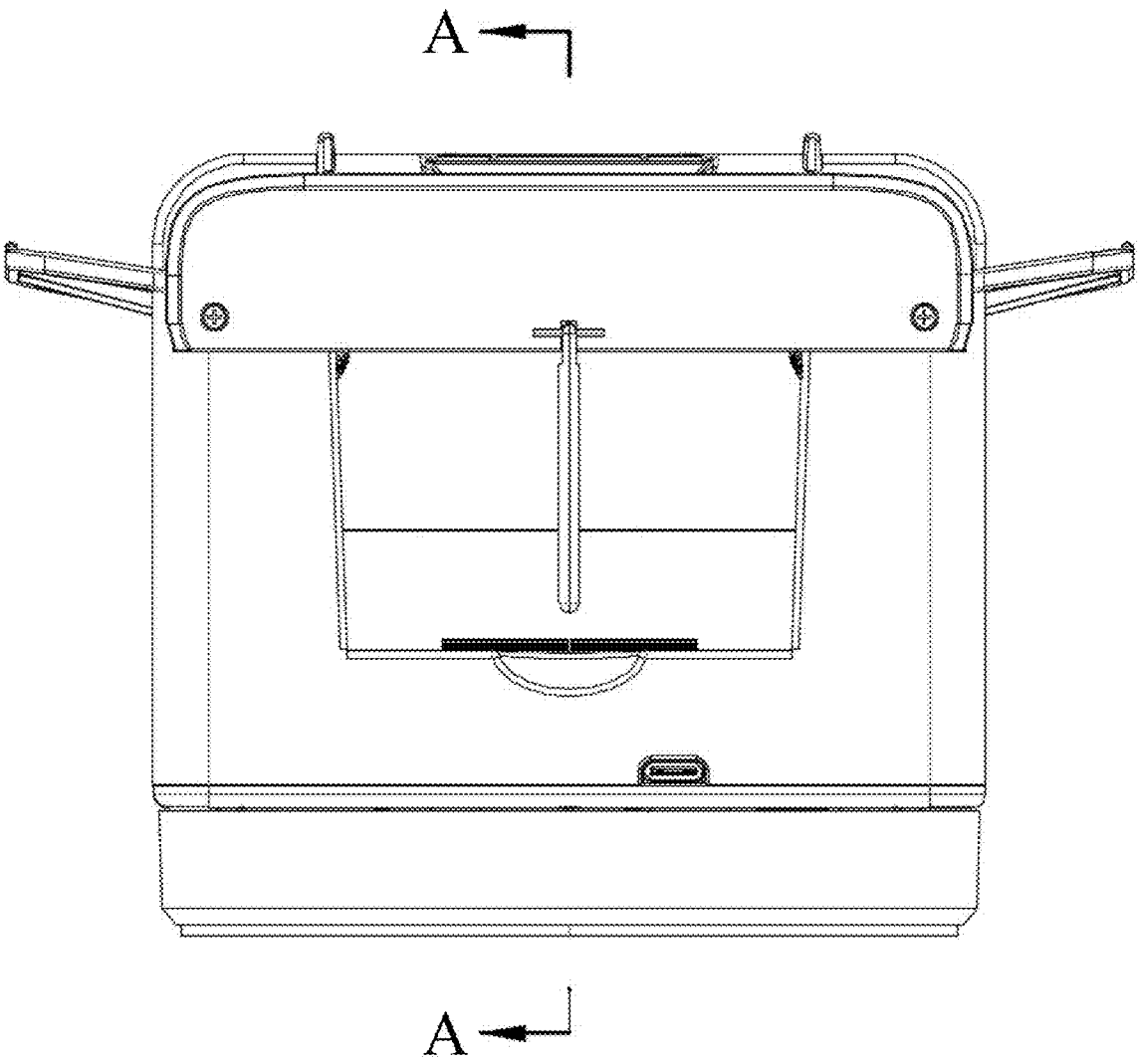
FIG. 11 is a schematic front view according to the present disclosure.

As shown in FIG. 10, in the present embodiment, the card-shuffling mechanism 300 includes a card-shuffling roller assembly 320 and a card-shuffling motor 330 that provides power for the card-shuffling roller assembly 320. The card-shuffling motor 330 drives the card-shuffling roller assembly 320 to rotate through certain transmission structures 530 (such as gear structures and rotating rods) to generate friction with the playing cards, thereby driving the playing cards to move toward the card-shuffling channel 115.

In a preferred embodiment, a guiding member protruding toward the card compartment 111 is provided on a side of the card-holding plate 200 adjacent to the card compartment 111. The guiding member can guide the playing cards entering the card compartment 111 from the card-shuffling channel 115 to limit an inclination angle of the playing cards when entering the card compartment 111, so as to prevent the playing cards from being interlaced due to excessive tilt, and avoid the playing cards standing in the card compartment 111 to cause card jams, thereby improving the card-shuffling smoothness of the card shuffling-and-dealing integrated machine. Especially when there are a few playing cards left on the card-holding plate 200 and the playing cards enter the card-shuffling channel 115, the arrangement of the guiding member can prevent the side of the playing cards adjacent to the card-holding plate 200 from tilting, causing the playing cards to be excessively tilted into the card compartment 111 and resulting in card jams.

Specifically, in the present embodiment, as shown in FIGS. 1, 2, 4, 7 and 10, the guiding member is a guiding roller 340. When the playing cards pass above the guiding roller 340, the guiding roller 340 may roll to reduce the friction between the guiding roller 340 and the playing cards, making the card-shuffling process smoother.

In the present embodiment, as shown in FIG. 10, the guiding roller 340 is dynamically connected to the card-shuffling mechanism 300, so that the guiding roller 340 also rolls in a direction of card-delivering, providing power for the playing cards on the guiding roller 340 to further improve card-shuffling efficiency and smoothness of the card shuffling-and-dealing integrated machine. In a preferred embodiment, the guiding roller 340 is connected to the transmission structure 530 through a conveyor belt. The conveyor belt is sleeved on a peripheral side of the guiding roller 340. The conveyor belt may provide power in the direction of card-shuffling for the playing cards above the guiding roller 340 in order to make the car-shuffling process smoother and the card-shuffling efficiency higher.

As shown in FIGS. 2 and 14, a control circuit board 1000 is provided inside the housing 100. A first control panel 1100 is provided on an upper part of the main housing 110 adjacent to the card-dealing port 114. A second control circuit board 1200 is provided on an upper side of the upper baffle 120. The first control panel 1100, the second control panel 1200, the card-shuffling mechanism 300, the card-delivering mechanism 400 and the card-dealing mechanism 500 are correspondingly and electrically connected to the control circuit board 1000. The first control panel 1100 is arranged at an angle, which is very attractive, but it is difficult for players from other directions to operate the first control panel 1100, so that the second control panel 1200 is provided on the upper side of the upper baffle 120.

Further, as shown in FIGS. 1 and 14, the main housing 110 is also provided with a battery 1300 and a charging port 117.

The working principle of the present disclosure is roughly as follows. The playing cards are divided into two stacks and placed on the card-holding plates 200 on the two sides of the main housing 110 respectively, and the card-shuffling function is activated. Under the action of the card-shuffling mechanism 300, the playing cards on the card-holding plates 200 pass through the card-shuffling channel 115 and stagger into the card compartment 111 to complete the card-shuffling. Then the card-dealing function is activated. The card-delivering mechanism 400 may deliver the playing cards in the card compartment 111 to the card-delivering port 113, and the card-dealing mechanism 500 may deal the playing cards located in the card-delivering port 113 from the card-dealing port 114. When multiple positions are required to deal the playing cards, the rotating base 600 drives the housing 100 to rotate and changes a direction of the card-dealing port 114, thereby dealing cards in multiple directions.

The above is only used to illustrate the technical solution of the present disclosure without limiting it. Other modifications or equivalent substitutions made by those of ordinary skill in the art to the technical solution of the present disclosure shall be covered by the claims of the present disclosure as long as they do not depart from the spirit and scope of the technical solution of the present disclosure.

What is claimed is:

1. A card shuffling-and-dealing integrated machine, comprising:

a housing having a card compartment for accommodating playing cards, a card access port located on a rear side of the card compartment, a card-delivering port located on a front bottom of the card compartment, and a card dealing port located on a front side of the housing and corresponding to the card-delivering port;

at least two card-holding plates provided on the housing and located on an upper peripheral side of the card compartment, a card-shuffling channel being provided between the card compartment and the card-holding plate;

a card-shuffling mechanism correspondingly provided at an entrance of the at least two card-holding plates adjacent to the card-shuffling channel, and configured to stagger the playing cards on the at least two card-holding plates into the card compartment respectively through the card-shuffling channels;

a card-delivering mechanism provided at a bottom of the card compartment, and configured to deliver the playing cards in the card compartment to the card-delivering port; and a card-dealing mechanism provided at the bottom of the card compartment and located between the card-delivering mechanism and the card-delivering port, and configured to deal the playing cards located at the card-delivering port from the card-dealing port.

2. The card shuffling-and-dealing integrated machine according to claim 1, wherein the housing includes a main housing having the card compartment, and an upper baffle located correspondingly on upper sides of the main housing and the card compartment;

wherein an extension portion that is upwardly protruding is provided on one side of the main housing away from the card access port, and the upper baffle is connected to the extension portion;

wherein two card-holding plates symmetrically arranged on two sides of the main housing adjacent to the extension portion are provided; and wherein the card-shuffling channel is located between the main housing, each of the two card-holding plates and the upper baffle.

3. The card shuffling-and-dealing integrated machine according to claim 2, wherein the upper baffle is provided with a card baffle on an upper side of the card access port, the card baffle extends to block a side of each of the two card-holding plates respectively on the two sides of the main housing facing the card access port to limit a position of the playing card located on the card-holding plate.

4. The card shuffling-and-dealing integrated machine according to claim 3, wherein the card baffle and the upper baffle are connected to each other in a pull-out manner, and, when the card baffle is pulled outward, the card baffle moves in a direction away from the extension portion.

5. The card shuffling-and-dealing integrated machine according to claim 4, wherein an inserting post is provided on an inner side of the card baffle and slidably inserted into the main housing and located at a lower side of each of the two card-holding plates.

6. The card shuffling-and-dealing integrated machine according to claim 4, wherein a limiting structure is provided between the card baffle and the upper baffle to limit a maximum slide-out position of the card baffle.

7. The card shuffling-and-dealing integrated machine according to claim 4, wherein a positioning structure is provided between the card baffle and the upper baffle, so that the card baffle is positioned at a predetermined position or any position.

8. The card shuffling-and-dealing integrated machine according to claim 4, further comprising: a card-blocking rod of which an upper end is rotatably connected to the card baffle and a lower end is a free end, and the card-blocking rod being configured to block the card access port, wherein the card-blocking rod is rotationally connected to the card baffle, and a rotating surface of the card-blocking rod is parallel to a surface of a card dealing direction of the card shuffling-and-dealing integrated machine.

9. The card shuffling-and-dealing integrated machine according to claim 1, further comprising: a card-blocking rod of which an upper end is connected to a part of the housing above the card access port and a lower end is a free end, and the card-blocking rod being configured to block the card access port, wherein the card-blocking rod is rotatably connected to the housing, and a rotating surface of the card-blocking rod is parallel to a surface of a card dealing direction of the card shuffling-and-dealing integrated machine.

10. The card shuffling-and-dealing integrated machine according to claim 2, wherein each of the card-holding plates is arranged at an angle, and a side of the card-holding plate connected to the extension portion is lower than a side of the card-holding plate adjacent to the card access port.

11. The card shuffling-and-dealing integrated machine according to claim 2, wherein an elastic floating member having a rebound direction facing downward is provided on a lower side of the upper baffle and at a middle of the card-shuffling channel.

12. The card shuffling-and-dealing integrated machine according to claim 1, wherein the at least two card-holding plates include a first card-holding plate located on the housing, and a second card-holding plate connected to the first card-holding plate and extending and suspending outwardly; wherein the second card-holding plate is trapezoidal-shaped, and a side of the second card-holding plate away from the first card-holding plate is a short side.

13. The card shuffling-and-dealing integrated machine according to claim 1, wherein a guiding member protruding toward the card compartment is provided on a side of each of the at least two card-holding plates adjacent to the card compartment to guide the playing cards entering the card compartment from the card-shuffling channel.

14. The card shuffling-and-dealing integrated machine according to claim 1, wherein the card-dealing mechanism includes:

a first card-delivering roller assembly located at a bottom of an interior of the card compartment and adjacent to the card access port;

a second card-delivering roller assembly located at the bottom of the interior of the card compartment and adjacent to the card-delivering port; and a card-delivering motor configured to correspondingly drive the first card-delivering roller assembly and the second card-delivering roller assembly to rotate.

* * * * *